US005129345A

United States Patent [19]

Senften

[11] Patent Number: 5,129,345

[45] Date of Patent: Jul. 14, 1992

[54] SYSTEM AND METHOD FOR AUTOMATICALLY STEERING A BOAT ALONG A PATH TO MAINTAIN A SELECTED DEPTH

[75] Inventor: David A. Senften, St. Peters, Mo.

[73] Assignee: Architectural Security Systems, Inc., St. Louis County, Mo.

[21] Appl. No.: 598,164

[22] Filed: Oct. 16, 1990

[51] Int. Cl.[5] ..... B63H 25/00

[52] U.S. Cl. ..... 114/144 E; 440/1; 440/6

[58] Field of Search ..... 114/144 R, 144 E, 144 B, 114/151; 440/1, 2, 6, 113; 43/26.1; 318/588; 367/106, 108, 111, 173; 364/432; 180/167–169, 271, 272, 274, 282

[56] References Cited

U.S. PATENT DOCUMENTS

| | | | |
|---|---|---|---|
| 4,856,613 | 8/1989 | Reginold | 180/282 |
| 4,984,464 | 1/1991 | Thomas et al. | 180/282 |
| 5,041,029 | 8/1991 | Kulpa | 114/144 E |
| 5,050,519 | 9/1991 | Senften | 114/144 E |
| 5,053,768 | 10/1991 | Dix, Jr. | 180/167 |

*Primary Examiner*—Jesus D. Sotelo

*Assistant Examiner*—Stephen P. Avila

*Attorney, Agent, or Firm*—Rogers, Howell & Haferkamp

[57] ABSTRACT

A system and method for automatically steering a boat in a body of water along a course to maintain a selected depth of water adjacent the boat. The actual depth of the water adjacent the boat is automatically detected. A desired depth is selected to be maintained adjacent the boat as the boat moves along. The actual depth and the selected depth are compared and the course heading of the boat is changed to a new course heading toward equalizing the actual and selected depths in response to detecting that the actual and selected depths are not equal. A depth reference is established defining whether the shallower water is to the left or right side of the boat, and the course heading is changed toward equalizing the actual and selected depths further in response to the depth reference. Allowances are automatically made for conditions where course changes are not desirable, and course heading references are established from which course headings are changed and where limits are established restricting the degree of change to enhance the system's capability to maintain a course at the selected depth.

29 Claims, 6 Drawing Sheets

SYSTEM AND METHOD FOR AUTOMATICALLY STEERING A BOAT ALONG A PATH TO MAINTAIN A SELECTED DEPTH

BACKGROUND AND SUMMARY OF THE INVENTION

This invention relates to a system and method for automatically steering or controlling a boat to direct the boat along a course so that the depth of water adjacent to the boat remains essentially constant at a pre-set selected depth. The invention has many potential uses, but has particular use with fishing boats where it is desired to fish at a selected depth while the boat is moving. A particularly preferred application of the invention is with recreational fishing boats where the user of the boat fishes while trolling. Such trolling is typically accomplished with electric trolling motors so that the present invention may be used in conjunction with a trolling motor for propelling and steering the boat along a course to automatically maintain a selected depth so that the user of the boat is free to fish without diverting his attention to driving the boat.

The desirability of fishing at a selected depth has long been known. Trolling motors have been used to move the boat slowly, and electronic depth finders have been used so that the operator of the boat could monitor the depth and manually steer the boat along a course in an effort to maintain a reasonably constant depth so that appropriate lures or bait could be presented to fish suspected to be present in the water at the selected depth. The problem with this technique is that it requires considerable attention by the operator such that the operator is diverted from the important task at hand, namely, fishing.

The present invention solves this problem, allowing the operator of the boat to devote attention to fishing while the boat is automatically steered along a course to maintain a selected depth.

Generally, in accordance with the invention the steering of the boat along the course to maintain the selected depth is accomplished by sensing the depth of the water adjacent the boat, such as by an ultrasonic or other type of ranging device. The information gathered by the ranging device is then transformed by suitable electronic circuitry to signals which automatically steer the boat, such as by turning a trolling motor, to move the boat along a course to maintain the selected depth. The invention automatically makes allowance for conditions where course changes are not desirable and provides course heading references from which course headings are changed and where limits are established restricting the degree of change to enhance the system's capability to maintain a course at the selected depth.

In accordance with the invention the operator of the boat directs the boat at an initial heading which is referred to herein as the initial baseline course heading which defines an initial course reference for the boat. Means are provided to the operator for inputting information into the system controller establishing a depth reference identifying shallower water as either on the left or right side of the boat. This information tells the controller whether shallower (or deeper) water is to the left or to the right of the initial baseline heading so that the controller can establish a new desired course heading in the proper direction as needed to maintain the selected depth. Means are also provided for the operator to input into the controller information representing a selected water depth to be maintained adjacent the boat as the boat moves along.

The system includes a ranging device, such as sonar or the like, for detecting the actual depth of the water adjacent the boat. Means are provided for comparing the actual depth with the selected depth and for detecting when the actual and selected depths are not equal. When the actual and selected depths remain unequal for a selected period of time, the system changes the course heading of the boat to a new desired course heading for the boat to follow. This new desired course heading is in a direction relative to the initial baseline heading so as to steer or move the boat in a direction toward equalizing the actual and selected depths based further on the input information as to whether shallower water is on the left or the right side of the boat. The new desired course heading is maintained for a selected time period while continuing to detect or measure the actual depth and comparing the actual depth with the selected depth. Preferably, the new desired course heading bears a pre-determined relationship to the initial baseline course heading and is selected to be within a pre-defined limit relative to the initial baseline heading. Further course changes to further new desired course headings are made, as needed, toward equalizing the actual and selected depths until the system detects that the actual and selected depths have become equal. When the actual and selected depths become equal resulting from a change to a new desired course heading, a new baseline course heading is established that bears a pre-determined relationship to the initial baseline course heading. The system establishes a new course heading for the boat, which may be the new baseline course heading, until a further change is needed to a new desired course heading in response to detecting that the actual and selected depths are no longer equal.

The system includes certain time delays to ensure that unnecessary course heading corrections are not made as might result, for example, where the bottom of the body of water is rough or uneven or where there is an abrupt but temporary change in depth due to a large rock, a hole, or the like.

Therefore, it is a primary object of this invention to provide a system and method which is accurate, reliable, and accommodates various conditions under which a boat is operated for automatically steering a boat along a course to maintain a selected depth.

DETAILED DESCRIPTION OF THE PREFERRED EMBODIMENT

Figure 1:
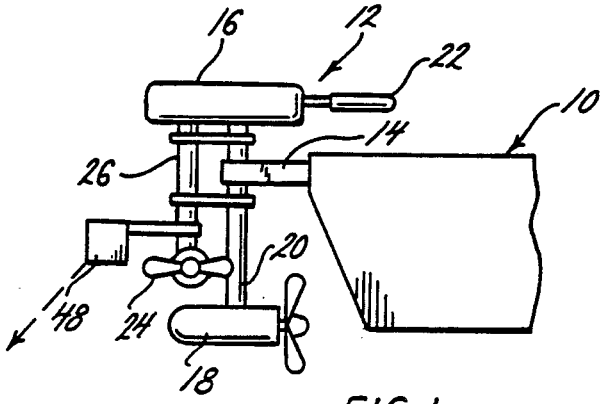
FIG. 1 is a view of a fragmentary bow portion of a boat having a trolling motor assembly, and schematically illustrating a system of the present invention used therewith.

With reference to FIG. 1 there is shown a boat 10 equipped with an electric trolling motor assembly 12 supported on the boat by a mounting bracket 14. The motor assembly 12 has a housing 16 and a propulsion motor 18 connected through a shaft 20. The motor 18 is controlled by speed control handle 22 through appropriate controls within the housing 16 and connected to the motor through the motor shaft. The motor assembly also includes a steering motor 24 supported from the housing 16 by a shaft 26. As seen from the drawing, the steering motor 24 is at right angles to the propulsion motor 18, and also at right angles to the longitudinal axis of the boat, so that operation of the steering motor in the forward or reverse direction will cause the boat to steer left or right.

Components of a system of the present invention for automatically steering the boat along a path to maintain a selected depth may be included within the housing 16 or otherwise conveniently located. The components and operation of the system will be explained with reference to FIGS. 3-5.

Figure 2:
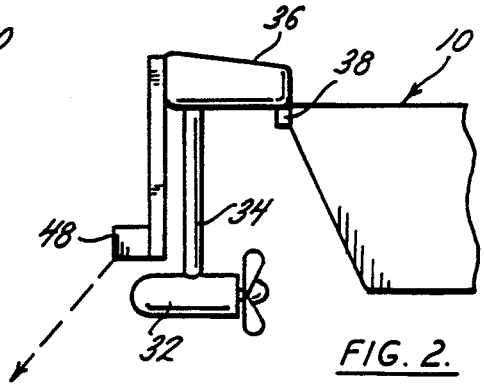
FIG. 2 is a view similar to FIG. 1 illustrating an alternate trolling motor structure.

FIG. 2 is a view similar to FIG. 1 but showing an alternate embodiment of an electric trolling motor assembly for propelling and steering the boat. In accordance with the alternate embodiment of FIG. 2, one trolling motor 32 is used to both propel and steer the boat. The motor is connected at the lower end of a shaft 34 that depends from a housing 36 which is attached to the boat by a suitable bracket 38. The shaft 34 is controlled to rotate and thus affects steering of the ,boat. The housing 36 contains suitable circuitry for causing the shaft and motor to rotate in response to signals from the system 30 of the present invention. Components of the system of the invention are located within the housing 36 as with the embodiment of FIG. 1. However, as with the embodiment of FIG. 1, they may be located as appropriate.

Figure 3:
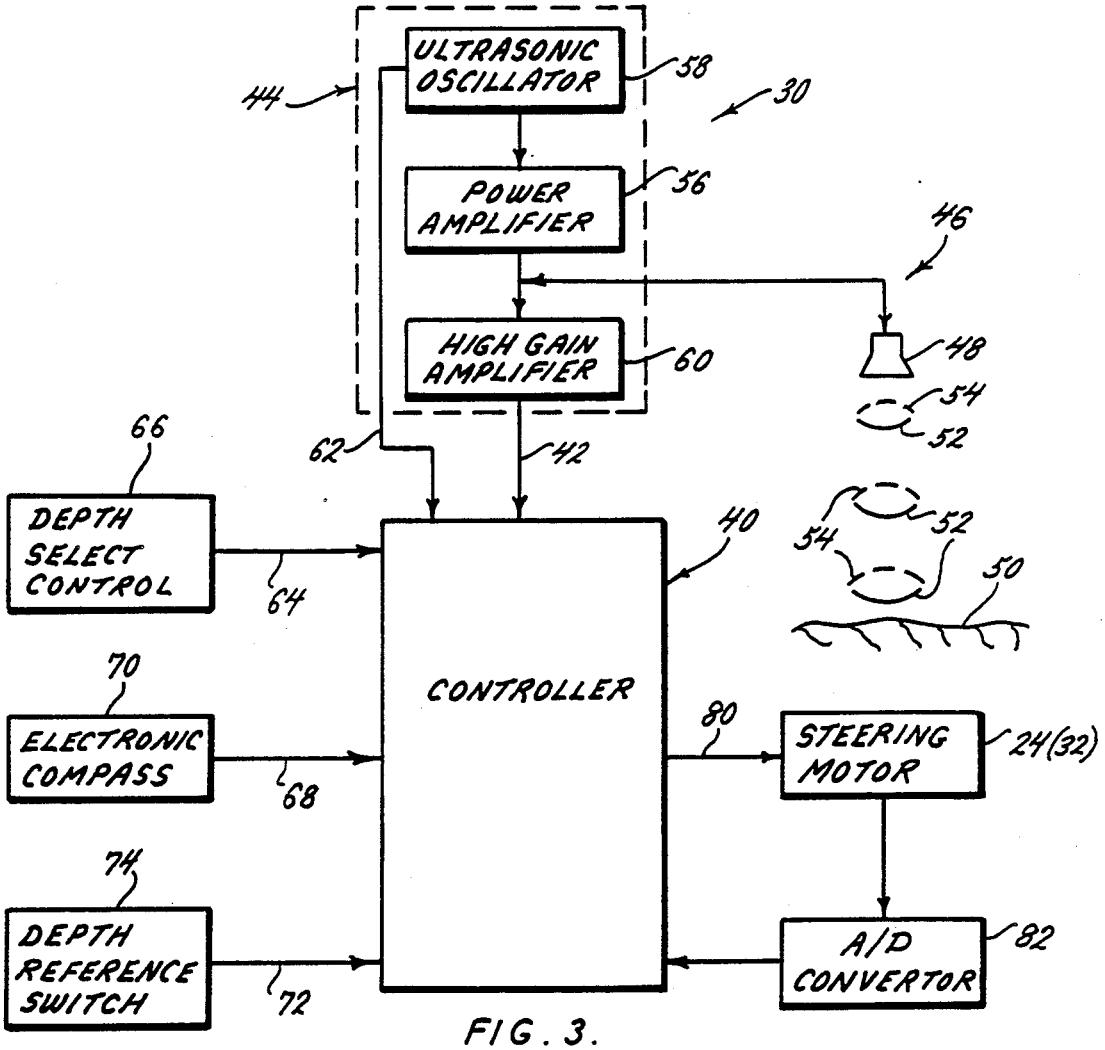
FIG. 3 is a schematic diagram of a system of the present invention.

With reference to FIG. 3, a system 30 of the present invention is schematically illustrated. The heart of the system is a controller 40 which may be either analog or microprocessor based. With the preferred embodiment as described herein, the controller 40 is microprocessor based. The operation of the controller will be explained with reference to the flow charts of FIGS. 4 and 6 and the diagrams of FIGS. 5 and 7 which illustrate examples of the operation of the system and method of the present invention.

The controller 40 receives an input 42 from the circuits 44 of an appropriate ranging device 46. The ranging device may be sonar or any other suitable device for sensing or detecting the distance of an object, which in this case is the bottom of the body of water. An ultrasonic transducer 48 broadcasts intermittent pulses toward the bottom 50 of the body of water in which the boat is operating. These pulses are illustrated at 52, and their echos are illustrated at 54. The detector 48 is driven by a power amplifier 56 which receives an input from an ultrasonic oscillator 58 which provides the drive through the power amplifier 56 for broadcasting the intermittent pulses toward the bottom. The echos 54 from the bottom are received by the transducer 48 and amplified by a high gain amplifier 60. These amplified signals are inputted at 42 to the controller 40.

Also inputted to the controller 40, as shown at 62, are signals from the ultrasonic oscillator 58. Hence, the controller 40 receives both the pulse generating signals, and the echo signals. From that information the controller computes the time that elapses between the broadcast of a pulse and the reception of its echo, and thereby computes the distance from the transducer 48 to the bottom 50 of the body of water which equates to the depth of the water.

Also input to the controller 40, as shown at 64 are signals representing a selected depth from a depth select control 66. With the control 66, the operator of the boat selects a desired depth to be maintained by the system as the boat moves along. As will be further explained, the information inputted to the controller representing the selected depth is compared with the information inputted to the controller representing the actual depth, and appropriate steering corrections are made in response to that information under certain conditions.

Compass heading information is input to the controller at 68 from an electronic compass 70. Hence, the electronic compass generates signals to the controller representative of the boat's actual heading. It is also used to establish an initial baseline course heading as will be further explained.

For the controller to generate signals for the necessary steering correction to maintain the selected depth, it must receive information identifying whether shallow water is to the left or right of the boat. This information is input to the controller at 72 by the operator of the boat from a manually operated depth reference switch 74. With the switch in one position, a signal is sent to the controller representing shallow water to the left side of the boat, and with the switch in the other position a signal is sent to the controller representing shallow water to the right side of the boat.

With the various input information, the controller operates in a manner to be described with reference to the flow charts and diagrams of FIGS. 4 through 7 to generate output signals at 80 for control of the steering motor 24 of FIG. 1 or 32 of FIG. 2 to effect a steering action of the motor assembly to steer the boat along a course to maintain a constant depth as selected by the operator with the depth select control 66.

Information from the steering motor 24 (32) is fed back to the controller through an A/D converter 82 for use by the controller in controlling the steering motor assembly.

Figure 4A:
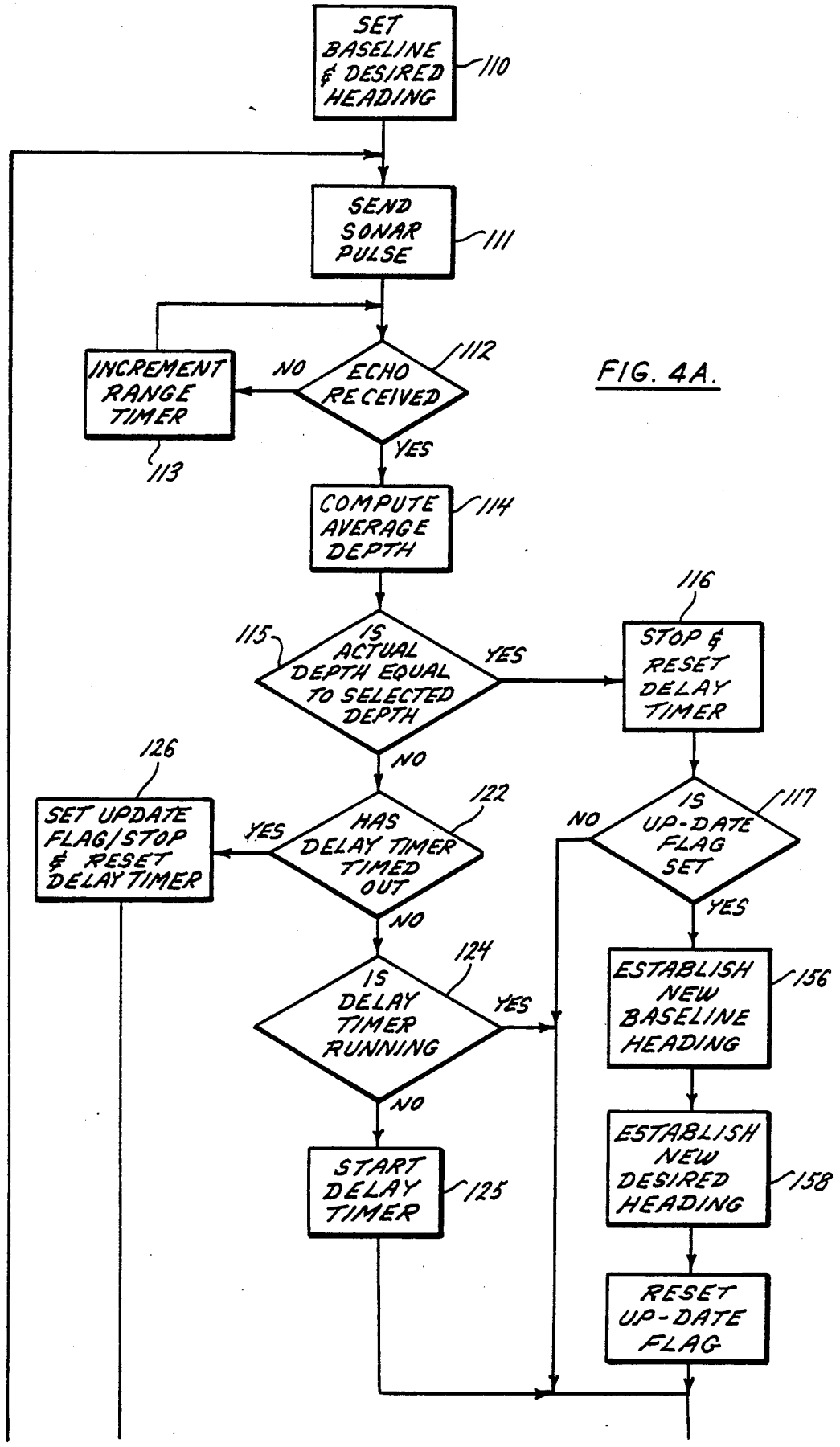
FIGS. 4A and 4B are a flow chart for a microprocessor based embodiment of the present invention explaining the operation of the system and method of the present invention.
Figure 4B:
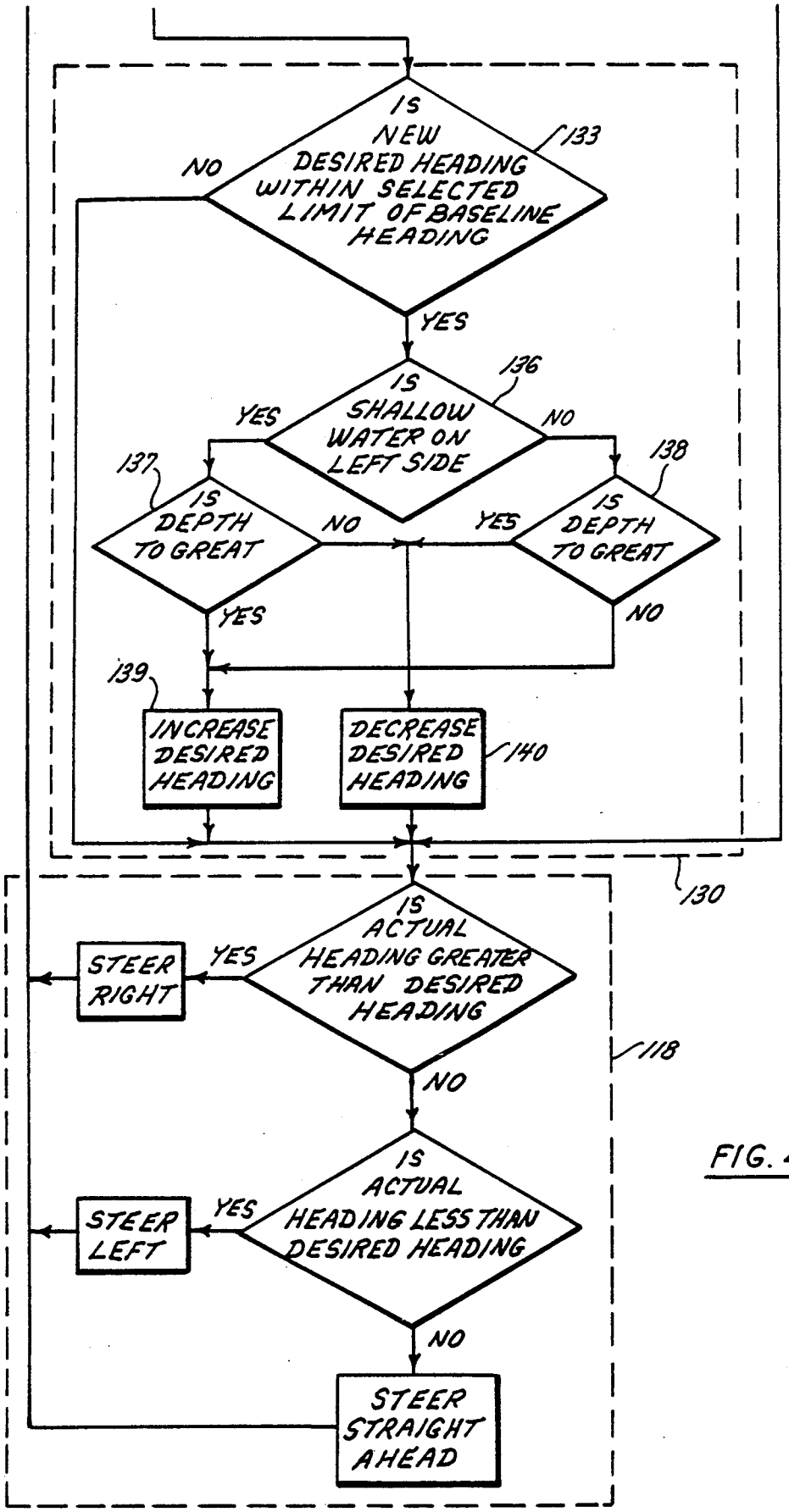
Figure 5:
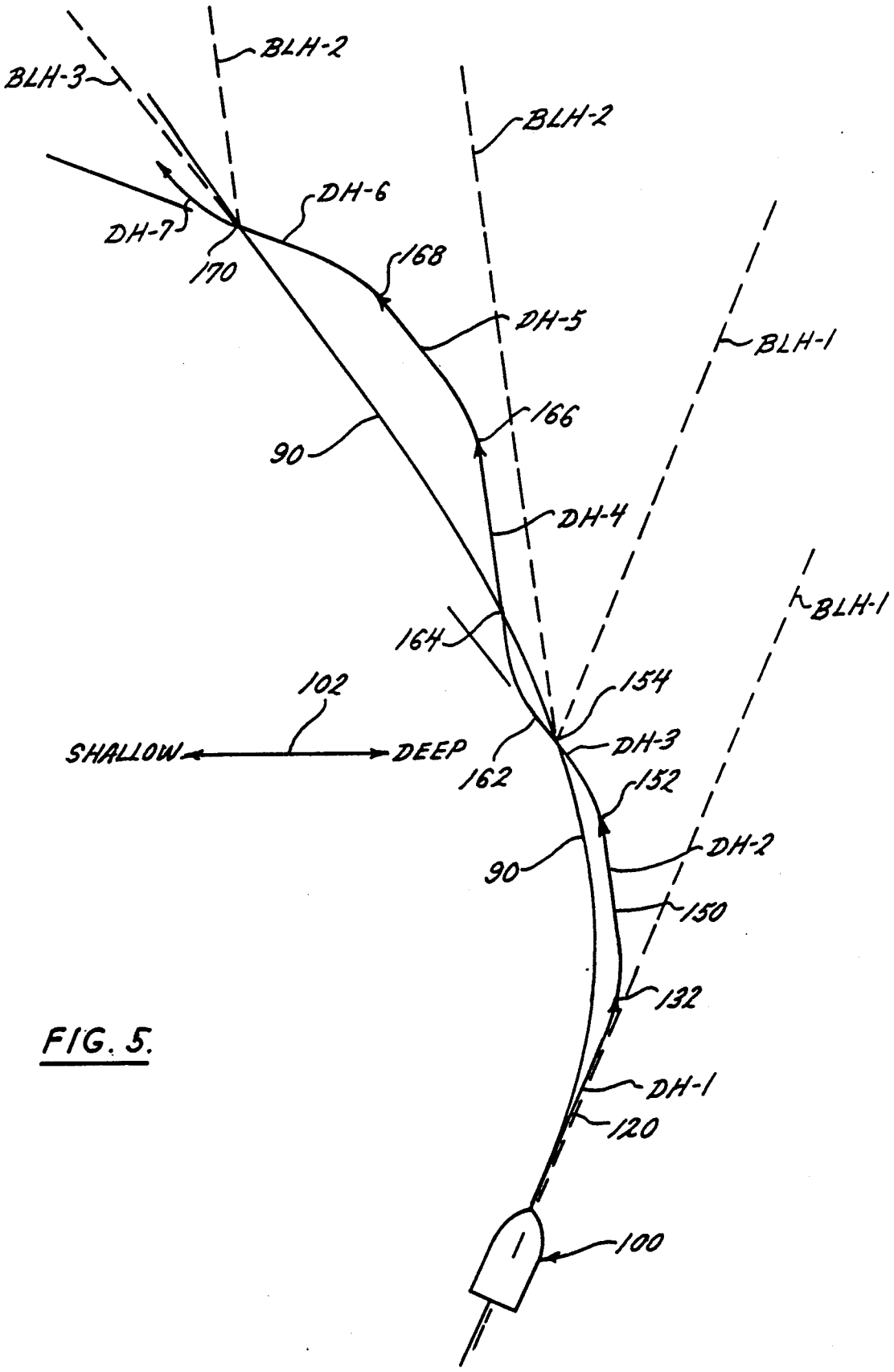
FIG. 5 is a diagram illustrating the operation of the present invention in conjunction with the flow chart of FIG. 4.

The operation of one embodiment of the microprocessor based controller 40 will now be explained with reference to the flow chart of FIG. 4 and the diagram of FIG. 5 which shows an example of how the system and method of the invention operates. It is to be understood that the diagram of FIG. 5 represents the operation of the system and method of the invention under certain operating conditions, and that the actual path or course of travel of the boat to maintain a selected depth will depend on the particular operating conditions. Hence, for the purpose of this example, 90 represents a course over a body of water that is of a depth selected by the operator of the boat. In other words, for the boat to maintain a particular selected depth as selected by the operator as the boat moves along, it must follow course 90. It will also be assumed that shallower water is to the left of the boat and deeper water to the right as shown by the arrow 102. That information is input to the controller by the operator by means of the depth reference switch 74. The operator also uses the depth select control 66 to select the depth to be maintained, which in this example is along the course 90.

The operator then directs the boat 100 along a course heading in the general direction that he would like the boat to travel. That heading is shown by the initial position of the boat 100 in the diagram of FIG. 5. That initial heading is designated the initial baseline course heading which is identified as BLH-1 on the diagram. The initial baseline course heading is input to the controller from the electronic compass 70 and is held in memory by operation of a suitable button or the like actuated by the operator of the boat. In other words, upon directing the boat initially at a heading selected by the boat operator, the boat operator then initiates the input of that heading from the electronic compass to the controller to establish the initial baseline course heading which the controller uses as a heading reference from which heading changes are made.

Also, by way of the example, it will be assumed that upon establishing the initial baseline course heading, the boat is at the selected depth. This would not have to be the case, but it is useful to establish an initial starting point for explaining the operation of the invention. Also, as will be further explained, the initial baseline course heading BLH-1 also represents an initial desired heading DH-1. As will be further explained, the desired headings change to effect course direction to maintain the selected depth, but for purposes of the example it will be assumed that initially the headings BLH-1 and DH-1 are the same. The setting of the initial baseline course heading and the desired course heading is shown at 110 at the top of the flow chart.

With the boat traveling at the selected depth and on its initial course as shown in FIG. 5, the sonar ranging device 44 sends sonar pulses and looks for echos. Signals representing the broadcast pulses are sent to the controller by way of input 62, and signals representing the echos are sent to the controller by way of input 42. By incrementing a range timer, a counter, the controller computes the actual depth. In practice it is to be understood that the controller will take an average of such depth readings. These operations are depicted in the flow chart at 111, 112, 113, and 114.

The controller makes a decision on whether the actual depth is equal to the selected depth. This is shown on the flow chart at 115. In the example, the boat 100 is initially at the selected depth. Therefore, a comparison of the actual depth with the selected depth results in the two being equal so that the decision at 115 is YES. With the actual and selected depths equal, a delay timer is stopped and reset as shown at 116. As will be explained, the purpose of the delay timer is to prevent overcorrecting as where the change in depth is only temporary as might be caused by wind or large rock or hole at the bottom of the body of water beneath the boat. The delay timer is stopped and reset each time the boat returns to the selected depth after having been off-depth for a selected time period.

The controller also checks to see if an update flag is set. As will be explained, the update flag is set only where the boat had been off course, meaning off the selected depth, for a selected time period and then was steered to a position at the selected depth.

For purposes of the example it is assumed that initially the boat was on course and was not previously off course for the required time period. Therefore, the update flag is not set as indicated at 117. Under these conditions the operation of the controller is depicted at that portion of the flow chart shown at 118 so that the boat is steered based only on the compass heading input at 68 and 70 of FIG. 3. In other words, as long as the boat is at the desired depth, it will be steered to maintain the desired course heading DH-1. This is accomplished at the portion 118 of the flow chart where it is determined whether the actual course heading is greater or less than the desired course heading, and as a result the boat is either steered straight ahead, steered right or steered left as shown.

As the boat moves along the course DH-1 it will reach a location at about 120 where the depth is deeper than the desired depth. The controller will recognize that the actual depth and desired depth are not equal. Hence, the decision at 115 as to whether the actual depth is equal to the selected depth will result in a NO. If an inequality is indicated, a decision is made at 122 as to whether the delay timer has timed out. As previously explained, the purpose of the delay timer is to ensure that desired course headings are not changed until a selected time period has transpired. Because the boat had been at the selected depth just prior to its travel to the position 120, the delay timer had been stopped and reset at 116. Therefore, at decision 122 the delay timer is in a reset condition and has not timed out. So under these conditions the decision at 122 results in a NO. Next a decision is made at 124 as to whether the delay timer is running. If it is, the boat continues to steer along the desired heading DH-1 by operation of the portion 118 of the flow chart as previously explained. If the delay timer is not running, then the delay timer is started as shown at 125. The delay timer then continues to run with the boat steering along the course DH-1 as shown by the portion 118 of the flow chart.

As the boat continues to steer along the initial desired course heading DH-1, the controller continues to compute the average depth at 114, make a comparison of the actual depth with the desired depth at 115, and steer the boat along the desired heading DH-1 until the timer times out. When this occurs, as shown by the decision at 122, the delay timer is stopped and re-set, and the update flag is set as shown at 126. Also, when the delay timer times out, the portion of the flow chart shown at 130 is activated to either increase or decrease the desired course heading. Note that the only time the portion 130 is activated to either increase or decrease the desired course heading is when the controller detects that the actual depth is not equal to the selected depth and this condition has existed for a selected time period which is the time required for the delay timer to time out.

The boat will travel along the initial desired heading DH-1 which is the same as with the initial baseline heading BLH-1 until the delay timer times out which places the boat at a position 132 in FIG. 5. When the delay timer times out, the system makes a course heading correction in an effort to steer the boat toward the course 90 representing the selected depth. However, in accordance with this embodiment of the invention, the system will change the boat's course only within a selected limit from its original baseline heading BLH-1. This limit may be empirically selected and appropriate means may be provided for the operator of the boat to change that limit. For example, the limit might be selected at 90° from the initial baseline heading, which means that the system will not steer the boat a total of more than 90° from the original baseline heading even though the changes in headings do not steer the boat to a location where the actual and selected depths become equal. This will prevent the boat from going around in circles if unable to find the selected depth.

Therefore, after the delay timer has timed out, a decision is made at 133 as to whether the new desired heading is within the selected limit of the baseline heading. If it is not, the boat continues to steer along the course DH-1 without a new desired heading being established. However, if the new desired course heading is within the selected limit of the baseline heading, a decision is made at 136 as to whether the shallow water is on the left side. Decisions are then made at 137 and 138 as to whether the depth is too great, and based on those decisions the desired heading is either increased or decreased at 139 and 140, respectively. Then by either increasing or decreasing, as appropriate, the desired heading, the boat is either steered right or steered left in response to operation of the portion 118 of the flow chart to maintain the boat along the new desired heading until again the delay timer times out or the boat is steered to a position where the actual and selected depths are equal, whichever occurs first.

Referring again to the example of FIG. 5, with the boat at position 132 when the timer times out, and because the new desired heading is within the limit of the initial baseline heading BLH-1, the desired heading is changed to a new desired heading DH-2. Because the shallow water is to the left, and the water depth at location 132 of the boat is too deep, the desired heading is increased as shown by 139 of the flow chart to the new desired heading DH-2.

The amount of any increase or decrease in the desired heading may be empirically determined and the microprocessor programmed accordingly. For example, it may be found that course changes of 30° are desirable. Or it may be found that rather than the degree of course change remaining constant whenever a course change is needed, the degree of course change may be varied. For example, it may be found desirable to increase the degree of each succeeding course change where multiple course changes are needed to steer the boat back to the desired depth. Many such options are available with microprocessor technology. With this example it is assumed that each desired course change is a constant, and in this example each such change has been selected to be 30°.

Hence, the new course heading DH-2 is a 30° increase from the initial course heading DH-1. The boat will now follow the new course heading DH-2 along the course segment 150 of FIG. 5. The boat will continue along the course DH-2 while the system continues to measure the actual depth and compare those measurements with the desired depth. As the boat continues along the course 150 the controller will continue to detect that the actual depth is greater than the selected depth and will continue to steer on course DH-2 as long as the delay timer continues running. When the delay timer times out the boat will be at a location 152 resulting in another increase in the desired heading to a new heading DH-3, assuming that the new heading DH-3 is still within the selected limit of the baseline heading as indicated at 133 of the flow chart. For example, if the limit is 90°, and the total change in desired heading from DH-1 to DH-3 is 60°, the desired heading DH-3 is within the selected limit so that the system will establish the new desired heading DH-3. If it were not within the selected limit, the system would continue to steer the boat along the course DH-2 as shown by the NO decision at 133.

So now the system steers the boat along the course DH-3 and before the delay timer times out the boat reaches a position 154 where the actual depth equals the selected depth. This condition is indicated at 115 of the flow chart by the YES decision. With the boat at the selected depth, the delay timer is reset and stopped. Also, because the boat had been off the selected depth for a time period such that the delay timer had timed out, which occurred both during DH-1 and DH-2, the update flag was set at 126. Hence, with the update flag set, a new baseline heading is established by the controller as shown at 156 of the flow chart, and a new desired heading is established as shown at 158 of the flow chart. Also the update flag is reset so that new baseline and desired headings are not changed until after the boat has been off the desired depth for the time period determined by the delay timer. In other words, as long as the system is steering the boat on the selected depth course by following the last established desired heading, the baseline and desired headings are not changed.

In establishing new baseline and desired headings, the new baseline heading bears a pre-determined relationship to the previous baseline heading. Also, the new desired heading bears a relationship to the previous baseline heading. Referring to the example of FIG. 5, when the boat moves to the position 154 where the actual depth is equal to the selected depth, a new baseline heading BLH-2 is established. Its relationship to the baseline heading BLH-1 may be empirically determined. For purposes of this example, the new baseline heading BLH-2 has been selected to be halfway between the original baseline heading BLH-1 and the last previously established desired heading DH-3. Also with this example, the new desired heading DH-4 is established to be the same as the new baseline heading DLH-2. However, it is to be understood that the controller may be programmed to establish any workable desired relationship between the new baseline heading and the previously established baseline heading, and also between the new desired heading and the previously established baseline heading.

With the new desired heading DH-4 established to be the same as the new baseline heading BLH-2, when the boat moves past the location 154 as shown at 162, the system will steer the boat back to the right by operation of the portion 118 of the flow chart to maintain the boat on the course DH-4 until either the delay timer times out or the boat is steered back to the selected depth course, whichever occurs first. With the example shown, the boat is steered along the course DH-4 to a location 164 where the actual and selected depths are again equal, before the delay timer times out. The boat will continue along the desired heading DH-4 moving into deeper water until the delay timer times out whereupon the boat is located at the position shown by 166. With the delay timer having timed out, a new desired heading DH-5 is established by operation of the portion 130 of the flow chart, the new heading being within the selected limit of the last previously established baseline heading BLH-2. The boat travels along the desired heading DH-5 until the delay timer again times out at boat position 168. The boat still not having moved back to the desired depth course 90, the desired heading is again increased to a new desired heading DH-6 which is still within the selected limit of the baseline heading BLH-2. The boat travels along the desired heading DH-6 and moves to position 170 back on the depth course 90 before the delay timer times out.

With the boat back on the depth course 90 such that the actual and selected depths are again equal, a new baseline heading BLH-3 is established which bears a pre-selected relationship to the last previously established baseline heading BLH-2 and the last desired heading DH-6. Also, a new desired heading DH-7 is established, which in this example is established to be the same as the new baseline heading BLH-3. Therefore, the system steers the boat in a direction along the new desired heading BH-7.

In this way the system and method of the present invention steers the boat by making changes in baseline and desired headings to maintain the boat along the desired depth course.

While a particular example has been used for ease in understanding the operation of the invention, it is to be understood that there are many other examples, each depending on the particular depth contour of the body of water over which the boat travels, but that the principles of operation of the invention remain the same.

Figure 6A:
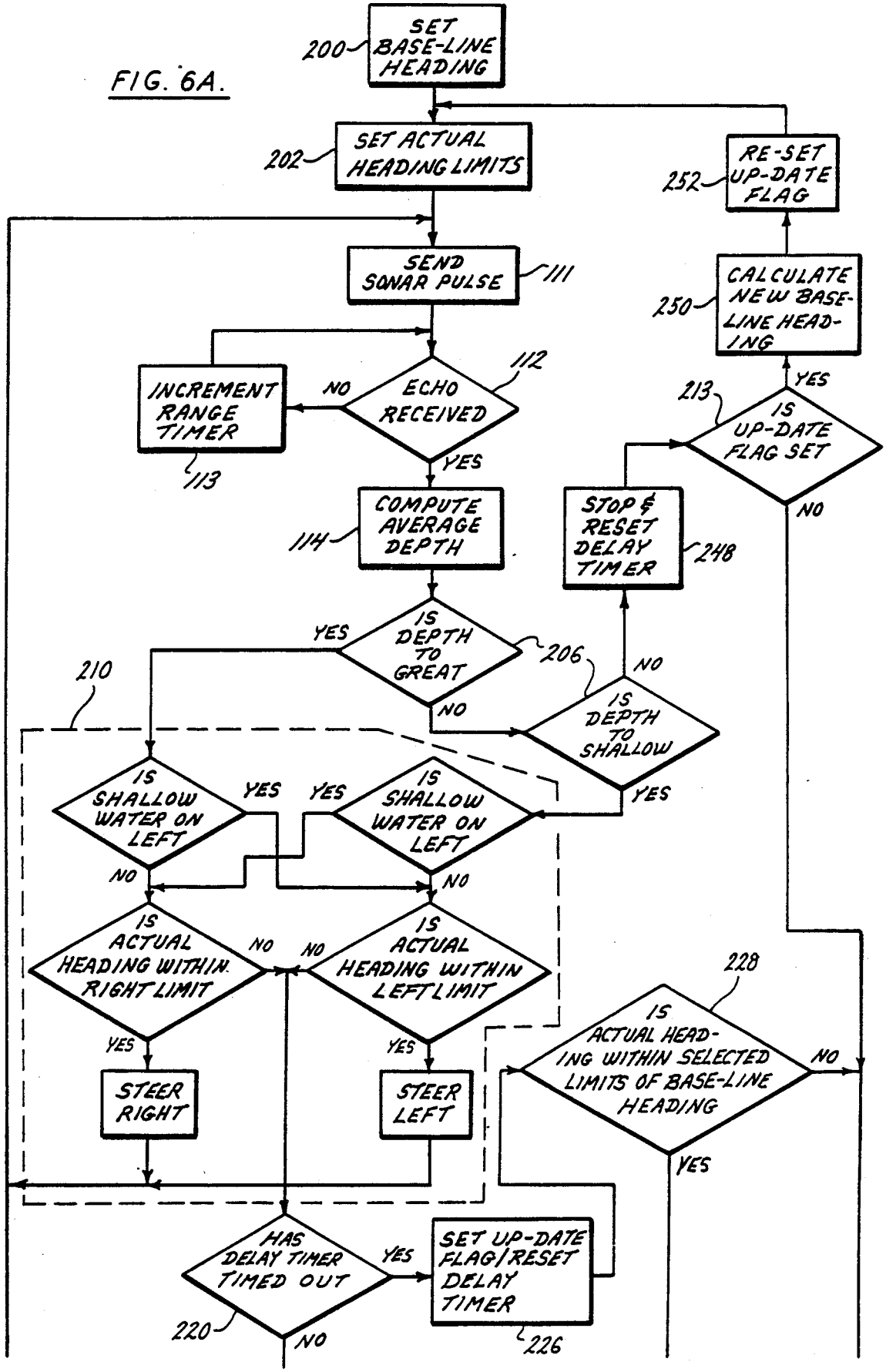
FIGS. 6A and 6B are a flow chart for another microprocessor based embodiment of the invention.
Figure 6B:
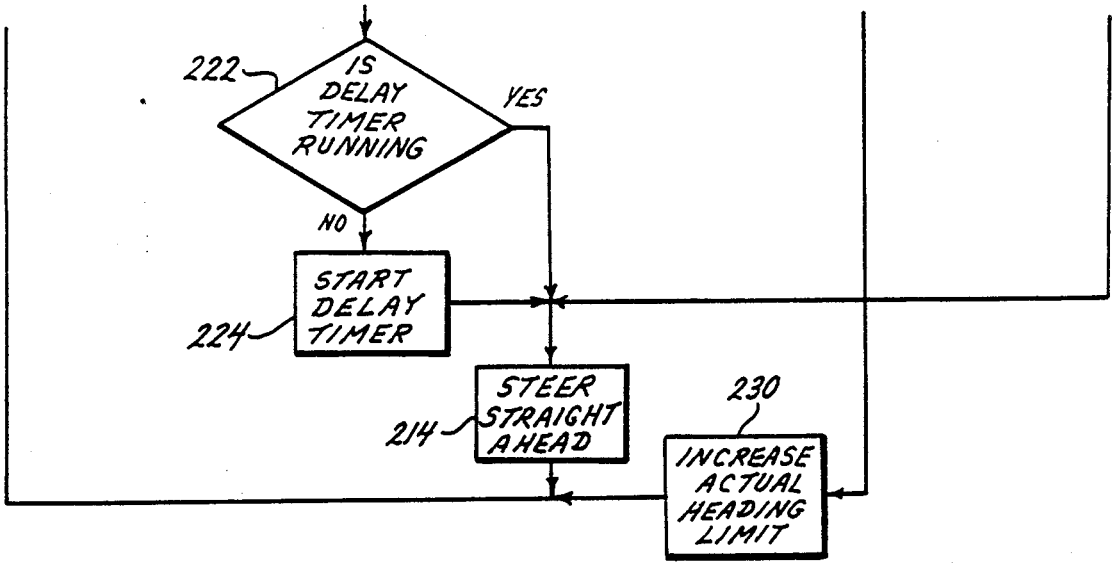
Figure 7:
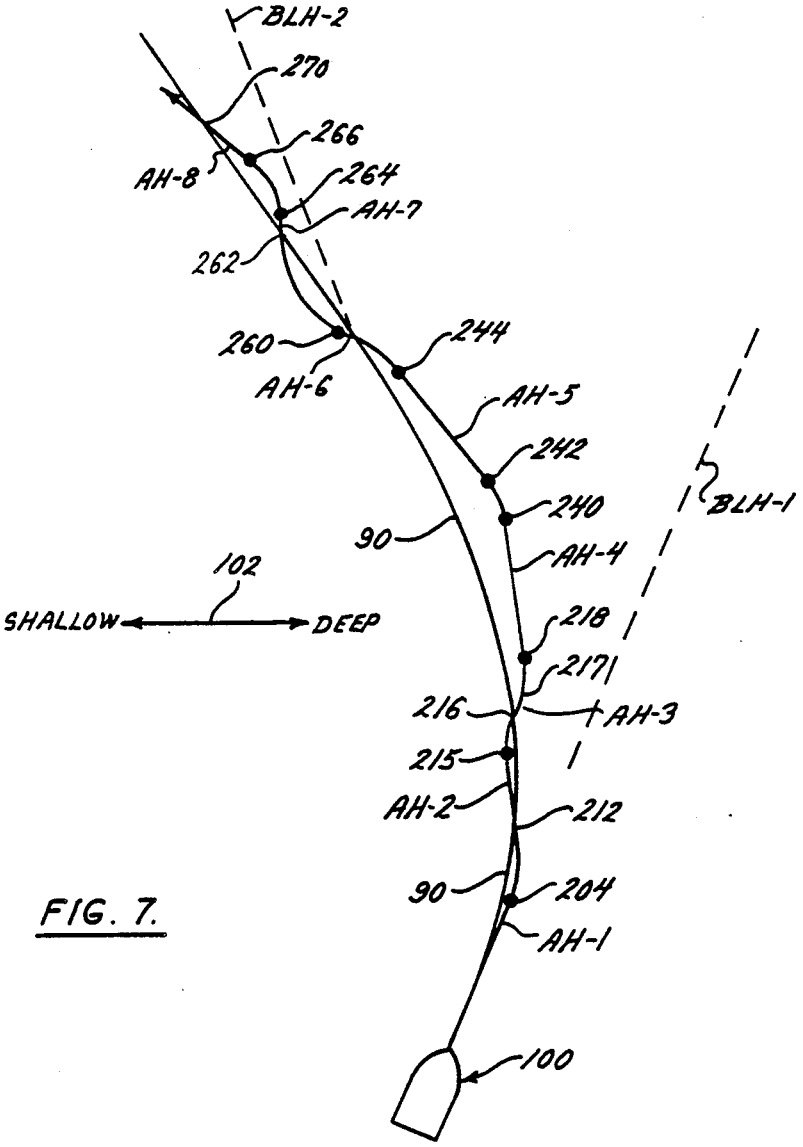
FIG. 7 is a diagram illustrating the operation of the present invention in conjunction with the flow chart of FIG. 6.

Another embodiment of the invention is shown by the flow chart of FIG. 6 and the diagram of FIG. 7. The hardware used with this embodiment as shown in FIGS. 1 through 3 is essentially the same as with the first embodiment.

In accordance with this embodiment of the invention, the boat is allowed to steer within selected limits from a baseline heading upon detecting that the actual and selected depths are not equal immediately after the boat having been on the selected depth path. Unlike the first embodiment where the boat is steered by compass along actual headings and changes in the actual headings are made by establishing new desived headings, with this embodiment of the invention the boat is steered within set limits in response to depth without establishing new desived headings. When the system detects that the actual depth is not equal to the selected depth, it causes the boat to steer right or left, as appropriate, to change the actual course heading of the boat. The steering actions continues until either the boat moves to a position where the actual and selected depths are equal, or until the boat reaches the maximum actual heading deviation allowed by the actual heading limits set in the system, whichever occurs first. If the boat steers to the maximum actual heading deviation, it will maintain that maximum heading until the actual and selected depths are equal or for a specified time period, whichever occurs first. If the time period expired before the actual and selected time period, whichever occurs first. If the time period expired before the actual and selected depths are equal, the system may select new actual heading limits causing the boat to steer so as to affect a new course change within the new selected limits. As with the first described embodiment, this embodiment establishes a maximum limit to which the actual heading may deviate from the last established baseline heading. The embodiment will be more fully described with reference to the example illustrated by the diagram of FIG. 7 and the flow chart of FIG. 6.

As with the first embodiment, it will be assumed that the boat 100 initially is traveling at a baseline heading BLH-1, and thus also represents an initial actual heading AH-1 for the boat. On the flow chart of FIG. 6, the initial baseline heading BLH-1 is set at 200. Also, the limits within which the boat is allowed to steer or deviate from BLH-1 are set at 202 of the flow chart. These limits may be empirically determined, and may or may not remain constant. For example, the system may be programmed so that the limits change with each succeeding steering correction. However, for purposes of this example, it will be assumed that the set limits remain constant, and for this example limits of 30° left and 30° right of the baseline heading have been selected. This means that if the boat is caused to steer left or right, it will not steer more than 30° from its last established baseline heading unless new limits are established as will be explained.

The path 90 selected for this embodiment is the same as with the first embodiment to illustrate the differences in the way the two embodiments function.

As the boat 100 moves along BLH-1, it will reach a position 204 where the actual depth is greater than the selected depth as detected at 206 of the flow chart. Note that 111 through 114 of the flow chart are the same as with the first embodiment. Of course, the sensitivity of this detection can be selected, i.e., the amount by which the boat is allowed to deviate from the selected depth before an inequality is detected.

With shallow water to the left and deep water to the right, as with the first embodiment, upon detecting that the actual depth is greater than the selected depth the boat will be caused to steer left in accordance with the portion 210 of the flow chart. The boat will still steer left until it reaches an actual heading which is the maximum deviation from BLH-1, or until the actual and selected depths are equal, whichever occurs first. In this example the boat moves to position 212 where the actual and selected depths are equal before it reaches the maximum heading deviation. When this occurs it will be moving along a new actual heading AH-2.

When the boat reaches position 212 such that the actual and selected depths are equal, this condition is noted at 206 of the flow chart whereupon a decision is made at 213 as to whether an update flag is set. The update flag is set only where the boat had been traveling for a predetermined period of time as established by a delay timer where the actual and selected depths were not equal. With this example such a condition has not yet occurred so the update flag is not set. Hence, the boat steers straight ahead as shown at 214 of the flow chart.

The boat will move along AH-2 until it reaches position 215 where the system detects that the actual depth is less than the selected depth as determined at 206 of the flow chart. This causes the boat to steer right as shown by portion 210 of the flow chart.

The boat will steer right until it reaches a position where the actual and selected depths are equal, or until it reaches the maximum deviation or steering limit from BLH-1, whichever occurs first. With this example, the boat reaches position 216 where the actual and selected depths are equal before it reaches the maximum steering limit. When this occurs the boat will steer straight ahead along a new actual heading AH-3.

When the boat reaches position 217 the system detects that the actual depth is greater than the selected depth and causes the boat to steer left. Now the boat steers to position 218 and takes on actual heading AH-4 which is the maximum deviation from BLH-1 that the boat is allowed to steer in accordance with the actual heading limits established at 202 of the flow chart. Hence, a decision is made at 210 of the flow chart as to whether the actual heading is within the left limit. When the boat reaches position 218 the answer to that question is NO. Then, a decision is made at 220 as to whether the delay timer has timed out. With this example, the delay timer has not timed out and is not running because the boat had just previously crossed the path 90 where the actual and selected depths were equal. So at 220 the delay timer has not timed out, and at 222 the delay timer is not running, so the delay timer is started at 224 of the flow chart.

The boat continues to steer straight ahead along course AH-4 as shown at 214 of the flow chart. It will continue along this course until the delay timer times out. When this occurs as determined by 220 of the flow chart, the update flag is set at 226, the delay timer is reset, and a determination is made as to whether the actual heading is within the selected limits of the baseline heading as shown at 228 of the flow chart. This is similar to the decision made at 133 of the flow chart of FIG. 4 with respect to the first embodiment. As with the first embodiment, the limit set at 228 may be imperically determined. For purposes of this example such limit is set at 90° so that the most that the boat will be allowed to steer from the last established baseline heading BLH-1, even with changes in the actual heading limits, is 90° with this example.

The actual heading AH-4 is within 90° of BLH-1, so the decision at 228 is YES. As a result, the actual heading limit is increased. As previously explained, the amount of this increase may be the same as the first established actual heading limit, or it may be difference. With this example, the increase is the same, or another 30° for a total of 60° deviation from BLH-1.

These conditions are illustrated by the diagram of FIG. 7. The boat travels along course AH-4 until the timer times out which occurs at position 240. A new limit is established at 230 of the flow chart. The system continues to detect that the actual depth is greater than the selected depth so that the boat is then caused to steer left by operation of the portion 210 of the flow chart.

The boar steers left to position 242 whereupon it takes on heading AH-5 which is the maximum deviation from BLH-1 established by the new limit. This occurs before the boat is back on path 90. Hence, the actual heading is no longer within the left limit as noted by portion 210 of the flow chart so the delay timer is again started. The boat travels along course AH-5 until the delay timer times out at position 244 whereupon the actual heading limit is again increased at 230 of the flow chart, being still within the limit of the baseline heading BLH-1 established at 228 of the flow chart, i.e., within 90° of BLH-1.

Thus, the boat steers left at position 244 and moves to a position 246 where it is back on the path 90 where the actual and selected depths are equal as detected at 206 of the flow chart. The flow chart at 248 insures that the delay timer is stopped and reset. A determination is made at 213 as to whether the update flag is set. The flag was set at 226 because the delay timer had previously timed out. With the update flag set as noted at 213, a new baseline heading is calculated as noted at 250 of the flow chart and the update flag is reset as noted at 252. The boat continues to steer straight ahead along course AH-6, the actual heading of the boat when it moved to position 246.

The new baseline heading BLH-2 established at 250 of the flow chart may be selected as with the first described embodiment. In this example, it is selected to be half way between BLH-1 and AH-6. BLH-2 now becomes the base reference from which the actual heading limits are established.

When the boat moves to position 260, the system detects that the actual depth is less than the selected depth causing the boat to steer to the right until it is on the path 90 or it reaches the maximum deviation from the set actual heading limits. With this example, it reaches the path 90 first as shown at 262 whereupon it proceeds straight ahead along course AH-7. When it gets to position 264 the system detects that the actual depth is greater than the selected depth causing the boat steer left to position 266 whereupon it reaches the maximum set limit and proceeds straight ahead along course AH-8. When the boat reaches the maximum limit at position 266, the delay timer starts to run as shown at 220, 222, and 224 of the flow chart. The boat continues to steer straight ahead along course AH-8 as noted at 214 of the flow chart until either the timer times out or the boat reaches a position where the actual and selected depths are equal, whichever occurs first. With this example, the boat reaches position 270 on path 90 before the timer times out so that delay timer is stopped and reset at 248 and the boat continues straight ahead along course AH-8 until the system calls for another course change. The system continues to steer the boat along the path 90.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. A system for automatically steering a boat in a body of water along a course to maintain a selected depth of water adjacent the boat, said system comprising:

means for automatically detecting the actual depth of the water adjacent the boat;

means for selecting a water depth to be maintained adjacent the boat as the boat moves along;

means for comparing the actual depth with the selected depth, and for detecting when the actual and selected depths are not equal; and means, responsive to detecting that said actual and selected depths are not equal, for changing the course heading of the boat toward equalizing said actual and selected depths upon said detected inequality existing for a predefined period of time.

2. A system for automatically steering a boat in a body of water along a course to maintain a selected depth of water adjacent the boat, said system comprising:

means for automatically detecting the actual depth of the water adjacent the boat;

means for selecting a water depth to be maintained adjacent the boat as the boat moves along;

means for comparing the actual depth with the selected depth, and for detecting when the actual and selected depths are not equal;

means, responsive to detecting that said actual and selected depths are not equal, for changing the course heading of the boat toward equalizing said actual and selected depths; and means for steering the boat in response to compass headings.

3. The system of claim 2 wherein said means for changing the course heading of the boat toward equalizing said actual and selected depths further comprises means for changing the course heading of the boat to a new derived course heading.

4. The system of claim 1 further comprising means for establishing a depth reference defining whether shallower water is to the left or right side of the boat, said means for changing the course heading toward equalizing said actual and selected depths further being responsive to said depth reference.

5. The system of claim 4 further comprising means for establishing a baseline course heading defining an initial course reference for the boat, said means for changing the course heading toward equalizing said actual and selected depths further comprising means for steering the boat off the baseline heading within pre-defined limits.

6. The system of claim 3 further comprising means for changing the course heading of the boat, upon detecting that said actual and selected depths are not equal, only upon said detected inequality existing for a pre-defined period of time.

7. The system of claim 5 further comprising means for establishing a new baseline course heading upon said actual and selected depths becoming equal, said new baseline heading bearing a pre-determined relationship to the last previously established baseline heading.

8. The system of claim 6 further comprising means for establishing a new baseline course heading upon said actual and selected depths becoming equal, said new baseline course heading bearing a predetermined relationship to the desired course heading of the boat upon said actual and selected depths becoming equal and the last previously established baseline heading.

9. The system of claim 1 wherein said depth detecting means further comprises means for generating signals from said boat toward the bottom of the body of water to create reflected echos of said signals, means at said boat for receiving the reflected echos, and means for detecting the depth of the water in response to the elapsed time between the generation of the signals and the receipt of the echos.

10. The system of claim 9 wherein said signals are ultrasonic pulses.

11. The system of claim 8 wherein said new baseline course heading is selected to lie between the desired course heading of the boat upon said actual and selected depths becoming equal and the last previously established baseline course heading.

12. A system for automatically steering a boat in a body of water along a course to maintain a selected depth of water adjacent the boat, said system comprising:

means for establishing an initial baseline course heading defining an initial course reference for the boat;

means for establishing a depth reference identifying shallower water as either on the left or the right side of the boat;

means for selecting a water depth to be maintained adjacent the boat as the boat moves along;

means for detecting the actual depth of the water adjacent the boat;

means for comparing the actual depth with the selected depth and for detecting when the actual and selected depths are not equal;

means, responsive to detecting that said actual and selected depths are not equal for a selected time period, and further responsive to said shallower depth reference, for changing the course heading of the boat to a new desired course heading toward equalizing said actual and selected depths;

means for maintaining said new desired course heading for a selected time period while continuing to detect the actual depth and comparing the actual depth with the selected depth, said new desired course heading bearing a pre-determined relationship to the initial baseline course heading;

means, responsive to detecting that said actual and selected depths remain unequal for a selected time period, and further responsive to said shallower depth reference, for making further course changes to further new desired course headings, as needed, toward equalizing said actual and selected depths, each new desired course heading bearing a predetermined relationship to the initial baseline course heading;

means, responsive to detecting that said actual and selected depths have become equal, resulting from a change to a new desired course heading, for establishing a new baseline course heading that bears a pre-determined relationship to the initial baseline course heading; and means for maintaining the course heading of the boat along a new course heading until a further change is needed in response to detecting that said actual and selected depths are not equal.

13. The system of claim 12 wherein the degree of change of course headings to new desired course headings from a given baseline course heading is limited to within pre-defined limits.

14. The system of claim 12 wherein said new baseline course heading is selected to lie between the desired course heading of the boat upon said actual and selected depths becoming equal and the last previously established baseline course heading.

15. The system of claim 12 wherein said depth detecting means further comprises means for generating signals from said boat toward the bottom of the body of water to create reflected echos of said signals, means at said boat for receiving the reflected echos, and means for detecting the depth of the water in response to the elapsed time between the generation of the signals and the receipt of the echos.

16. The system of claim 15 wherein said signals are ultrasonic pulses.

17. A system for automatically steering a boat in a body of water along a course to maintain a selected depth of water adjacent the boat, said system comprising:

means for establishing an initial baseline course heading defining an initial course reference for the boat;

means for establishing a depth reference identifying shallower water as either on the left or the right side of the boat;

means for selecting a water depth to be maintained adjacent the boat as the boat moves along;

means for detecting the actual depth of the water adjacent the boat;

means for comparing the actual depth with the selected depth and for detecting when the actual and selected depths are not equal;

means for establishing an actual heading limit with reference to said initial baseline course heading within which said boat is allowed to steer;

means, responsive to detecting that said actual and selected depths are not equal, and further responsive to said shallower depth reference, for steering the boat within said limit toward equalizing said actual and selected depths;

means for continuing to steer the boat toward equalizing said actual and selected depths until the boat moves to a position where said actual and selected depths are equal or until the boat steers to said actual heading limit, whichever occurs first;

means for maintaining the heading of the boat at the maximum actual heading limit, if said limit is reached before said actual and selected depths become equal, for a selected time period while continuing to detect the actual depth and comparing the actual depth with the selected depth;

means, responsive to detecting that said actual and selected depths remain unequal for a selected time period, and further responsive to said shallower depth reference, to further steer the boat within a new actual heading limit toward equalizing said actual and selected depths, said new actual heading limit bearing a predetermined relationship to the initial baseline course heading;

means, responsive to detecting that said actual and selected depths have become equal, resulting from the establishment of a new actual heading limit, for establishing a new baseline course heading that bears a predetermined relationship to the initial baseline course heading; and means for establishing an actual heading limit with reference to said new baseline course heading within which said boat is allowed to steer.

18. A method for automatically steering a boat in a body of water along a course to maintain a selected depth of water adjacent the boat, said method comprising the steps of:

automatically detecting the actual depth of the water adjacent the boat;

selecting a water depth to be maintained adjacent the boat as the boat moves along;

comparing the actual depth with the selected depth, and detecting when the actual and selected depths are not equal; and responsive to detecting that said actual and selected depths are not equal, changing the course heading of the boat toward equalizing said actual and selected depths upon said detected inequality existing for a predefined period of time.

19. The method of claim 18 further comprising the step of establishing a depth reference defining whether shallower water is to the left or right side of the boat, said step of changing the course heading toward equalizing said actual and selected depths further being responsive to said depth reference.

20. The method of claim 19 further comprising the step of establishing a baseline course heading defining an initial course reference for the boat, said step of changing the course heading toward equalizing said actual and selected depths further comprising steering the boat off the baseline heading within pre-defined limits.

21. The method of claim 20 further comprising the step of changing the course heading of the boat, upon detecting that said actual and selected depths are not equal, only upon said detected inequality existing for a pre-defined period of time.

22. The method of claim 20 further comprising the step of establishing a new baseline course heading upon said actual and selected depths becoming equal, said new baseline heading bearing a predetermined relationship to the last previously established baseline heading.

23. The method of claim 18 wherein said depth detecting step further comprises the step of generating signals from said boat toward the bottom of the body of water to create reflected echos of said signals, receiving the reflected echos, and detecting the depth of the water in response to the elapsed time between the generation of the signals and the receipt of the echos.

24. The method of claim 23 wherein said signals are ultrasonic pulses.

25. A method for automatically steering a boat in a body of water along a course to maintain a selected depth of water adjacent the boat, said method comprising the steps of:

establishing an initial baseline course heading defining an initial course reference for the boat;

establishing a depth reference identifying shallower water as either on the left or the right side of the boat;

selecting a water depth to be maintained adjacent the boat as the boat moves along;

detecting the actual depth of the water adjacent the boat;

comparing the actual depth with the selected depth and detecting when the actual and selected depths are not equal;

responsive to detecting that said actual and selected depths are not equal for a selected time period, and further responsive to said shallower depth reference, changing the course heading of the boat to a new desired course heading toward equalizing said actual and selected depths;

maintaining said new desired course heading for a selected time period while continuing to detect the actual depth and comparing the actual depth with the selected depth, said new desired course heading bearing a pre-determined relationship to the initial baseline course heading;

responsive to detecting that said actual and selected depths remain unequal for a selected time period, and further responsive to said shallower depth reference, making further course changes to further new desired course headings, as needed, toward equalizing said actual and selected depths, each new desired course heading bearing a predetermined relationship to the initial baseline course heading;

responsive to detecting that said actual and selected depths have become equal, resulting from a change to a new desired course heading, establishing a new baseline course heading that bears a pre-determined relationship to the initial baseline course heading; and maintaining the course heading of the boat along a new course heading until a further change is needed in response to detecting that said actual and selected depths are not equal.

26. The method of claim 25 wherein the degree of change of course headings to new desired course headings from a given baseline course heading is limited to within pre-defined limits.

27. The method of claim 25 wherein said new baseline course heading is selected to lie between the desired course heading of the boat upon said actual and selected depths becoming equal and the last previously established baseline course heading.

28. The method of claim 25 wherein said depth detecting step further comprises the steps of generating signals from said boat toward the bottom of the body of water to create deflected echos of said signals, receiving the reflected echos, and detecting the depth of the water in response to the elapsed time between the generation of, the signals and the receipt of the echos.

29. The method of claim 28 wherein said signals are ultrasonic pulses.

* * * * *